United States Patent [19]

Kawada et al.

[11] 4,346,852

[45] Aug. 31, 1982

[54] WEB WINDING DEVICE

[75] Inventors: Ken Kawada; Kazumasa Harada, both of Minami-ashigara, Japan

[73] Assignee: Fuji Photo Film Co., Ltd., Kanagawa, Japan

[21] Appl. No.: 200,358

[22] Filed: Oct. 24, 1980

[30] Foreign Application Priority Data

Oct. 26, 1979 [JP] Japan ..... 54-13854

[51] Int. Cl.[3] ..... B65H 35/02; B65H 19/04

[52] U.S. Cl. ..... 242/56.2; 242/56.9; 242/81

[58] Field of Search ..... 242/56.2, 56.3, 56.4, 242/56.5, 56.6, 56.7, 56.8, 56.9, 56 A, 58.6, 64, 81, 67.1 R, 81

[56] References Cited

U.S. PATENT DOCUMENTS 3,332,636 7/1967 Rockstrom ..... 242/56.2 X
3,690,583 9/1972 Herman ..... 242/81
3,949,948 4/1976 Tomma ..... 242/56.2
4,208,019 6/1980 Dusenbery ..... 242/56.9

*Primary Examiner*—Edward J. McCarthy
*Attorney, Agent, or Firm*—Sughrue, Mion, Zinn, Macpeak & Seas

[57] ABSTRACT

A web winding device of simple construction in which webs are successively attached to and wound on cores and in which the web winding width can be easily changed. A first web winding and product discharging station, a core supplying and web attaching station, and a second web winding and product discharging station are arranged in the stated order in a stationary frame. A winding unit having two web winding mechanisms coupled as a single unit extending in a longitudinal direction of the web is mounted on rails atop the stationary frame and is reciprocal therealong over the three stations. Each web winding device holds cores for the various web segments to be wound and motors for turning the cores and for adjusting the winding width.

7 Claims, 4 Drawing Figures

WEB WINDING DEVICE

BACKGROUND OF THE INVENTION

The present invention relates to devices for winding long, flexible belt-shaped material, hereinafter referred to as "a web" when applicable. More particularly, the invention relates to a web winding device in which, in a multi-slit type winding operation, webs are continuously wound on cores and a web winding width can be readily changed as required.

The term "multi-slit type winding" is intended to mean a winding system in which a web of relatively large width is slit into web segments of relatively small width while being unwound from a stock roll and the webs are wound on cores. In addition, the term "a web winding width" is intended to mean the width of a web segment to be wound on a core.

A winding operation in which a web is slit into web segments while being unwound from its stock roll and the web segments are wound on their respective cores has been employed in various industrial fields. In the case where the web winding width is maintained constant, it is of course unnecessary to change the web winding width. However, if a variety of products or web rolls are to be manufactured, it is necessary to change the web winding width depending on the type of product.

A conventional multi-slit type winding device for performing a continuous winding operation requiring a web winding width change is shown in FIG. 1. In that device, cores 2, such as hollow paper cores, are mounted on winding shafts 1 and webs W are simultaneously wound on the cores 2. Upon completion of the winding, a chucking nose 3 which rotatably holds one end of each winding shaft 1 is retracted axially so that the other end of the winding shaft can be readily removed from the frame 5. Thereafter, each winding shaft 1, including a number of web rolls Wr mounted thereon, is removed from the frame 5 manually or by a mechanical force such as that of a crane or a fork lift and a new winding shaft 1 is mounted on the frame 5. Preparation for winding the web winding width in the conventional device is carried out completely manually.

The conventional device suffers from difficulties that the necessary work accompanying a web roll switching operation such as the removal of the web rolls Wr, the replacement of the winding shafts 1 and the mounting of the cores 2 is troublesome, and as the web winding width is changed manually, the work time required is quite high. Thus, the conventional device is not considered completely practical.

In order to eliminate the above-described difficulties, a so-called "turret type web winding device" has been proposed in the art. In the device, the frame 5 of the above-described device is modified so as to be rotatable, the frame 5 thus modified is provided with a plurality of arms holding plural winding shafts 1 and cores 2, and the web winding system is divided into three axial turrets, specifically three stations respectively having a core supplying section, a web attaching and winding section, and a product or web roll discharging section.

In this device, the web winding operation is carried out continuously by turning the turrets. Therefore, the device is much improved in efficiency compared with the web winding device shown in FIG. 1.

However, a turret type web winding device is still disadvantageous in the following points. In order to turn the turrets, the device requires a number of components such as rotary joints and slip rings and accordingly the device is intrication in construction and high in manufacturing cost. In the case of changing the web winding width, it is necessary to change the positions of all of the above-described arms. If the positions of the arms are changed manually, much time and labor are required. The arms may be moved automatically by turning ball screws as disclosed in the specification of Japanese Laid-Open Patent Application No. 28084/1975. However, it should be noted that it is considerably difficult to accurately arrange a number of ball screws for the turning arms.

Accordingly, an object of the invention is to provide a web winding device of simple construction in which all of the above-described difficulties accompanying a conventional web winding device have been eliminated, webs can be successively attached to and wound on cores, and the web winding width can be readily changed.

SUMMARY OF THE INVENTION

The foregoing object and other objects of the invention have been achieved by the provision of a web winding device for continuously winding web pieces obtained by slitting a web on respective cores which, according to the invention, includes a stationary frame; a first web winding and product discharging station, a core supplying and web attaching station, and a second web winding and product discharging station arranged on the stationary frame in the stated order; and a winding unit having two web winding means which are coupled as a single unit extending in the longitudinal direction of the web. Each web winding means is adapted to hold cores for the web segments and to turn the cores to cause the web segments to be wound thereon. The winding unit is provided on the stationary frame in such a manner that the winding unit can be reciprocated over the stations.

DESCRIPTION OF THE PREFERRED EMBODIMENTS

Figure 1:
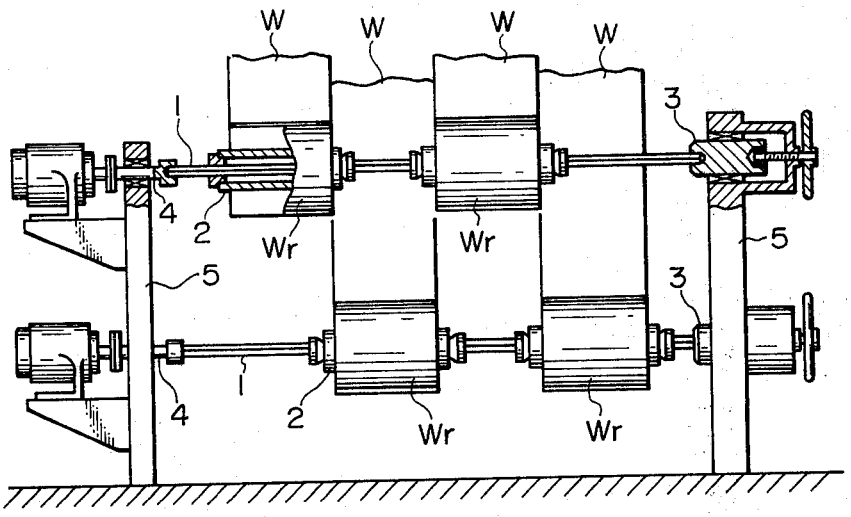
FIG. 1 PRIOR ART
FIG. 1 is a front view of a conventional web winding device.
Figure 2:
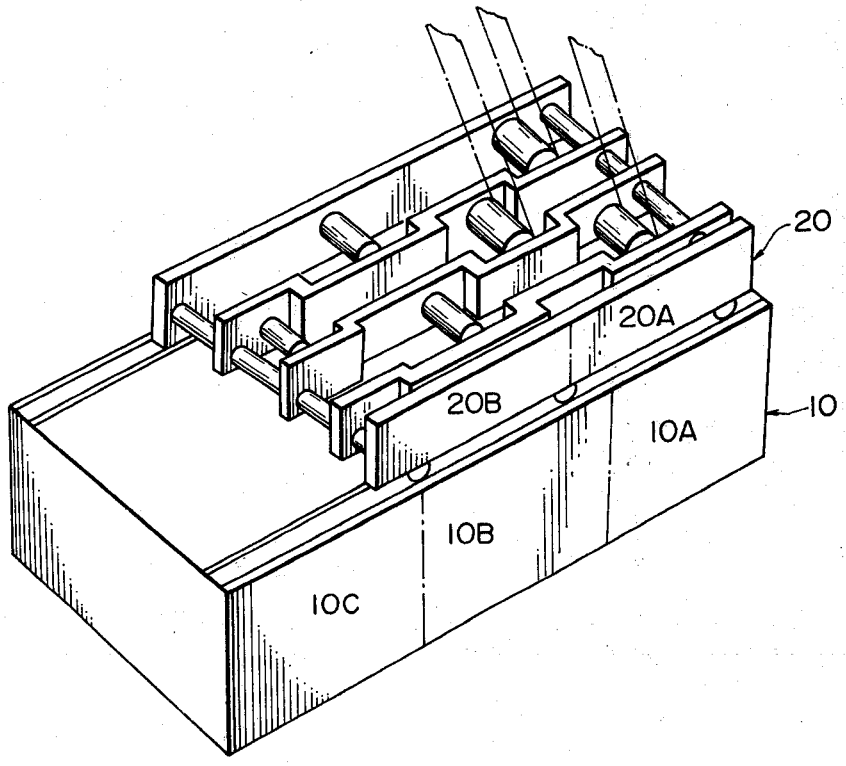
FIG. 2 is a perspective view of a preferred embodiment of a web winding device of the invention.
Figure 3:
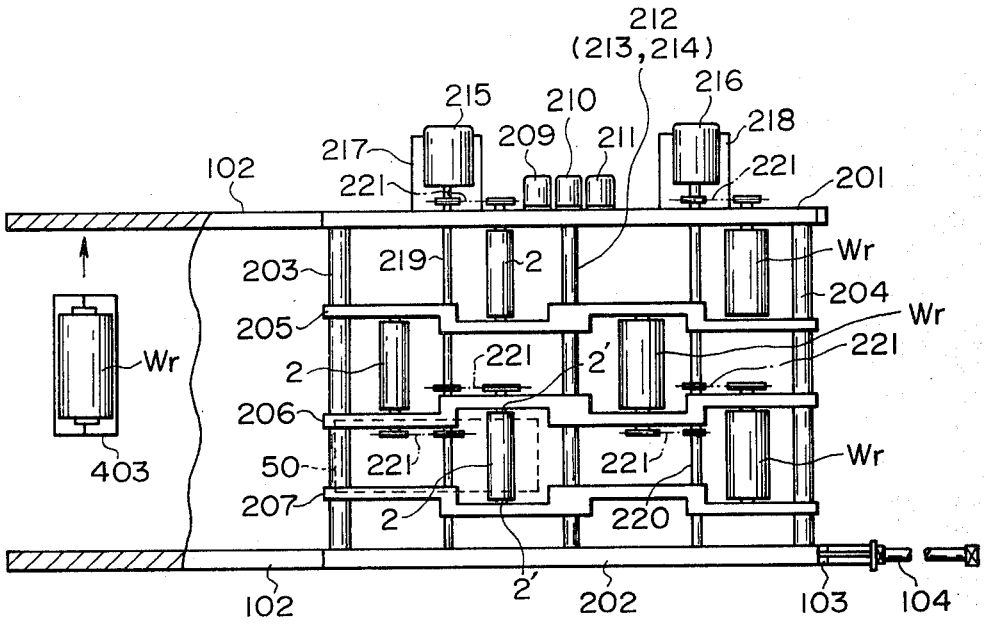
FIGS. 3 and 4 are a plan view and a front view, respectively, of the device shown in FIG. 2.
Figure 4:
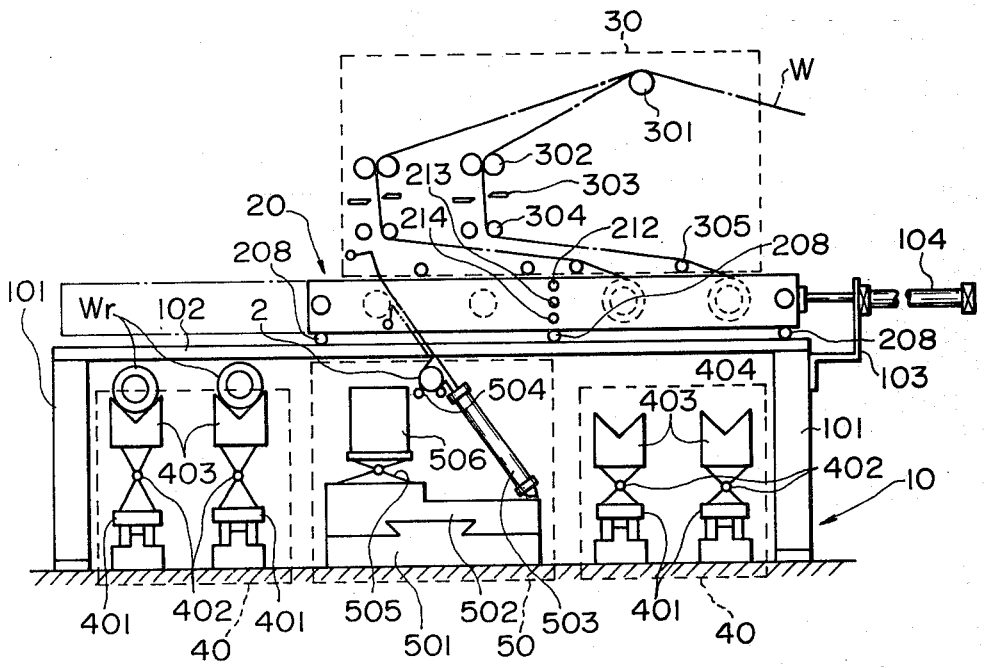

A preferred embodiment of the invention will be described with reference to FIGS. 2, 3 and 4. FIG. 2 is a perspective view showing the preferred embodiment of a multi-slit type web winding device (three slits in this case) constructed according to the invention and FIGS. 3 and 4 are, respectively, a plan view and a front view of the device.

The web winding device of the invention, as shown in FIG. 2, includes a stationary frame 10, a winding unit 20 running on the stationary frame 10, and the relevant peripheral equipment. The stationary frame 10 has three continuous stations 10A, 10B and 10C. In the station 10A, a web winding operation and a web roll Wr discharging operation are carried out, the web roll being a product obtained by winding a web. In the station 10B, winding cores are supplied and webs are attached to the winding cores. In the station 10C, similar to the station 10A, a web winding operation and a web roll Wr discharging operation are carried out. The winding unit 20 runs on the stationary frame 10 and is movable from the station 10A to the station 10C and from the station 10C to the station 10A.

The arrangement of the various components of the web winding device will be described with reference to FIGS. 3 and 4. The stationary frame 10 is mechanically rigidly assembled with rails on the upper ends of legs 101 the lower ends of which are fixedly secured to the floor. A bracket 103 is fixedly secured to one side of one of the legs 101 and a pneumatic cylinder 104 is coupled to the bracket 103. The pneumatic cylinder 104 operates to move the winding unit 20 from the station 10A to the station 10C or from the station 10C to the station 10A.

The winding unit 20 is made up of a frame which is formed by stationary side arms 201 and 202 and stays 203 and 204 which extend between the stationary side arms 201 and 202, crank-shaped winding arms 205, 206 and 207 provided in the frame, and web winding cores 2 held between the winding arms. Wheels 208 are provided at the lower ends of the stationary arms 201 and 202 so that the winding unit can run on the rails 102. Three motors 209, 210 and 211 are mounted on one side of the stationary arm 201. These motors are operated when a web winding width is to be changed. The motors are coupled to ball screws 212, 213 and 214. When the motors are operated in response to winding width changing signals, the winding arms 205, 206 and 207 are shifted in widthwise direction, respectively. In this operation, the winding arms 205, 206 and 207 are guided by the stays 203 and 204.

Two motors 215 and 216 are provided on brackets 217 and 218 which are mounted on the one side of the stationary arm 201. The motors 215 and 216 are web winding driving motors which are coupled to drive shafts 219 and 220, respectively. Driving forces transmitted to the drive shafts 219 and 220 from the motors 215 and 216 are transmitted through transmission means 221 such as chains or belts to core holding members 2'. The core holding members 2 are chucking/unchucking units as in a conventional web winding device and their construction is well known in the art.

The winding unit 20, as illustrated in FIG. 2, has two web winding devices 20A and 20B arranged side-by-side in the web winding direction with a total length substantially equal to the length of two stations, 10A and 10B for instance. As the winding unit 20 moves on the stationary frame 10, the winding devices 20A and 20B carry out the web winding operation alternately. The winding device 20A winds the web in the example illustrated.

The web W is introduced to the web winding device 20A or 20B through a web conveying and cutting device 30 indicated by dotted lines, in FIG. 4. The web conveying and cutting device 30 is made up of a pass roll 301, drive rolls 302, cutters 303 and pass rolls 304 and 305. The web W is run and unwound by a web unwinding device (not shown) and is then slit into plural web segments of a predetermined width. The web W thus slit is brought to the web conveying and cutting device 30. When each web is wound on a core 2 to a predetermined length to provide a final product or a web roll Wr, the product is cut from the succeeding web segment by the cutter 303. A web roll discharging device 40 is provided in each of the stations 10A and 10C of the stationary frame 10 and core supplying and web attaching devices 50 are provided in the station 10B. The web roll discharging device 40 is constituted by lifters 402 and product receivers 403 on the carriages 401 which run in the widthwise direction of the web.

Upon completion of a web roll Wr, the lifter 402 is raised to move the web roll Wr to the product receiver 403. When the lifter 402 is lowered, the carriage 401 is run to discharge the web roll Wr out of the web winding device. The core supplying and web attaching device 50 are provided respectively at web winding positions (three web winding positions in this example) in the station 10B. In each core supplying and web attaching device 50, an air cylinder 503 is arranged on the upper surface of a movable strand 502 which is movable in a widthwise direction on a stationary stand 501. The core supplying and web winding device 50 further includes a core supplying device having an automatic hand 504 coupled to the movable part of the air cylinder 503, a table lifter 505, and a web winding device 506 on the table lifter 505. The web winding device 506 is a conventional device of this type which is adapted to attach the web end to a core 2 specifically to attach the web end to a core 2 to which adhesive has been applied.

The core supplying device operates to hold with the hand 504 a core 2 which is supplied one at a time from a core hopper (not shown) to the device and to supply the core to the core holding device in association with the pneumatic cylinder.

The operation of the web winding device thus constructed will be described.

A web winding operation is carried out by the web winding device 20A of the winding unit 20 at the station 10A as shown in FIG. 2 and each web is wound up to a predetermined length. In this operation, new cores 2 for the following web winding operation are prepared by the core supplying device in the winding device 20B of the winding unit 20. The web rolls Wr are discharged by means of the carriage 401 at the station 10C.

When the web winding operation approaches its final stage, the speed of the motor 216 is gradually reduced in response to an instruction signal from a winding length detecting device (not shown) and the motor 216 is stopped whereupon the cutters 303 are operated to cut the webs W to separate the web rolls Wr therefrom. Thereafter, the drive shaft 220 is driven at a low speed and is then stopped when the rear portion of the web of each web roll Wr has been wound on its core 2. At that points, the after-winding operation of the web has been accomplished.

When the web rolls Wr are detained at predetermined positions, the table lifters 402, provided respectively for the web rolls, are raised to cause the product receivers 403 to receive the web rolls Wr while simultaneously the roll holding device 2' is released. The table lifters 402 are lowered so that the web rolls Wr are discharged from the device in association with the running of the carriers 401. Then the carriers 401 are returned to the original positions to be ready for discharging succeeding products. During this period, the webs W are wound on the respective cores 2 in the winding device 20B of the winding unit 20. More specifically, the table lifter 505 is raised so that the web winding device 506 approaches cores 2 held at predetermined positions. When the ends of the webs approach the cores 2, they are made to adhere to the respective cores 2 by an adhesive applied in advance. Then, the cores 2 are turned to cause the end portions of the webs W to be wound on the cores 2.

When the end portions of the webs have been wound on the cores 2 in the winding device 20B as described above, the lifter 505 is lowered and the winding unit 20 is shifted to the station 10C by the pneumatic cylinder 104 so that the next web winding operation can be carried out in the station 10C. The above-described operation is repeatedly carried out to continuously wind the webs W on the cores 2.

In the above-described embodiment, the web winding width is maintained unchanged. However, the width can be changed by operating the motors 209, 210 and 211. Specifically, the distances between the winding arms 205, 206 and 207 can be changed by operating the motors 209, 210 and 211 to shift the winding arms 205, 206 and 207.

The distances between the arms are determined in accordance with the selection of a web W winding width. That is, with the web W winding width selected, the number of revolutions of the ball screws 212, 213 and 214 is detected. When the number of revolutions has reached predetermined values, the motors 209, 210 and 211 are stopped. Since this arm positioning technique is well known in the art, a further description thereof will be omitted.

The web conveying and cutting device 30 and the web roll discharging device 40 are provided commonly for all the web widths and over the entire region in the widthwise direction of the device. Therefore, in changing the web winding width, it is unnecessary to change the positions of the devices 30 and 40.

As described above, in a web winding device according to the invention, the web winding and product discharging station 10A, the core supplying and web attaching station 10B and the web winding and product discharging station 10C are provided in the stationary frame 10 in the stated order and the winding unit 20 having the two winding means adapted to hold the cores 2 respectively for the webs and to turn the cores 2 to wind the webs thereon is provided on the stationary frame 10 in such a manner that it can be reciprocated over the stations in the stationary frame 10. With this construction, the web winding device of the invention has the following merits and effects:

(I) No rotary components such as expensive rotary joints and slip rings employed in the conventional turret type web winding device are used in the device of the invention. Therefore, the device of the invention can be manufactured at a low cost and it is of simple construction.

(II) While the webs W are being wound, the next cores can be prepared and the products can be discharged. Thus, the web winding operation can be continuously carried out.

(III) The core supplying and web attaching station and the web winding and product discharging stations can be arranged along a straight line irrespective of the web running system utilized and the device of the invention has an overall box shape. Therefore, the device is compact and high in rigidity.

Furthermore, the web winding width can be changed by automatically shifting the winding arms 205, 206 and 207 of the winding unit 20 and by moving the core supplying and web attaching device 50 in association with shifting of the winding arms. Therefore, the device of the invention has the following additional merit:

(IV) The number of winding arms to be shifted in the device of the invention is about half of that required in a conventional turret type web winding device. Therefore, the web winding width can be readily changed in a shorter time. Accordingly, as the number of web segments obtained by slitting the web is increased, the invention becomes more effective.

While there has been described a preferred embodiment of the invention, the invention is not limited thereto or thereby. That is, as is believed apparent to those skilled in the art, various changes and modifications may be made thereto within the spirit and scope of the invention as defined by the appended claims.

What is claimed is:

1. A web winding device for continuously winding web segments produced by slitting a web comprising:

a stationary frame;

a first web winding and product discharging station, a core supplying and web attaching station, and a second web winding and product discharging station arranged side-by-side in said stationary frame in the stated order; and a winding unit having two web winding means which are coupled together extending in the longitudinal direction of said web, each of said web winding means being adapted to hold a core for a corresponding one of said web segments and to rotate said cores to cause said web segments to be wound thereon, said winding unit being reciprocatably mounted on said stationary frame in such a manner that said winding unit is reciprocatable over said stations.

2. The device as claimed in claim 1 in which said winding unit comprises a plurality of winding arms which are movable in the widthwise direction of said web with one end in the widthwise direction of said web as a reference.

3. The device as claimed in claim 1 wherein said stationary frame comprises a plurality of vertically-extending legs and parallel rails rigidly coupled on the upper ends of said legs and wherein said winding unit comprises wheels positioned to ride on said rails.

4. The device as claimed in claim 3 wherein said winding unit comprises a first plurality of electric motors mounted on said frame, a ball screw operatively coupled to each of said motors, and a winding arm operatively coupled to each of said ball screws, said winding arm being shifted in a widthwise direction in response to operation of the corresponding electric motor.

5. The device as claimed in claim 4 wherein each of said winding means comprises a web winding driving motor, a drive shaft coupled to each of said web winding driving motors, and a plurality of core holding members, one of said core holding members being operatively coupled to be rotated by a corresponding one of said drive shafts.

6. The device as claimed in claim 1 further comprising a web conveying and cutting device mounted at a position above said winding unit.

7. The device as claimed in claim 6 wherein said web conveying and cutting device comprises a first pass roll; a plurality of pairs of drive rolls, one of said pairs of drive rolls being provided for each of a plurality of webs; a plurality of cutters, one of said cutters being provided for each of said webs; and a plurality of second pass rolls disposed to direct said webs into said winding unit.

* * * * *